US005895324A

United States Patent [19]

Inada

[11] Patent Number: 5,895,324

[45] Date of Patent: Apr. 20, 1999

[54] PROCESS FOR FORMING AXIALLY-EXTENDABLE BOLT BY UPSETTING

[75] Inventor: Takeshi Inada, Tokai, Japan

[73] Assignee: Toyota Jidosha Kabushiki Kaisha, Toyota, Japan

[21] Appl. No.: 08/909,056

[22] Filed: Aug. 11, 1997

[30] Foreign Application Priority Data

Aug. 29, 1996 [JP] Japan ..... 8-229041

[51] Int. Cl.[6] ..... B21H 3/02

[52] U.S. Cl. ..... 470/11; 470/16; 72/318

[58] Field of Search ..... 470/8, 9, 11, 12, 470/16, 57, 65, 86, 152, 153, 191; 72/318, 344, 359

[56] References Cited

U.S. PATENT DOCUMENTS

| | | | |
|---|---|---|---|
| 3,126,561 | 3/1964 | Orloff | 470/11 |
| 3,191,204 | 6/1965 | McClellan et al. | 470/191 |
| 4,805,437 | 2/1989 | Heil, Jr. et al. | 72/359 |
| 4,838,062 | 6/1989 | Prenn | 72/318 |

FOREIGN PATENT DOCUMENTS

A-63-43737 2/1988 Japan .

A-9-52141 2/1997 Japan .

*Primary Examiner*—Joseph J. Hail, III
*Assistant Examiner*—Ed Tolan
*Attorney, Agent, or Firm*—Oliff & Berridge, PLC

[57] ABSTRACT

An axially-extendable-bolt forming process by upsetting includes preparing a die having a through bore, and an internal upsetting cavity and a buffer space, a rod-shaped bolt precursor and a knock-out member, primarily pressing a leading end of the bolt precursor onto a leading end of the knock-out member, and secondarily pressing the bolt precursor onto the knock-out member. In the preparing step, the bolt precursor and knock-out member are fitted into the through bore of the die so that they can be brought into contact with each other. In the primarily-pressing step, the leading end of the bolt precursor is swollen finely and is brought into contact with an inner peripheral surface of the through bore of the die so that an excess material, being present adjacent to a leading-end surface of the bolt precursor, is flowed out into the buffer space. As a result, an axially-and-outwardly projecting flash is formed on a leading-end outer periphery of the bolt precursor so that irregularities, having been generated by shearing, are equalized. In the secondarily-pressing step, an intermediate portion of the bolt precursor is swollen in the internal upsetting cavity, and the bolt precursor is provided with an upset portion.

10 Claims, 4 Drawing Sheets

PROCESS FOR FORMING AXIALLY-EXTENDABLE BOLT BY UPSETTING

BACKGROUND OF THE INVENTION

1. Field of the Invention

The present invention relates to a process for forming a bolt, for instance, to a process which is appropriate for processing an axially-extendable bolt by upsetting.

2. Description of Related Art

An axially-extendable bolt has been known conventionally. The axially-extendable bolt includes an intermediate leg portion and a threaded leading-end leg portion, and is formed so that the intermediate leg portion has a smaller diameter than that of the threaded leading-end leg portion. As a result, the intermediate leg portion is likely to be extended by an axial tensile force. In general, the axially-extendable bolt has been manufactured in the following manner.

First, a workpiece is prepared by shearing a metallic rod-shaped blank. Then, the resulting workpiece, or a rod-shaped bolt precursor is subjected to drawing by using a forming apparatus. Thus, a leg member having a predetermined diameter is formed, and simultaneously a head member is formed. Moreover, the bolt precursor is subjected to upsetting by using another forming apparatus as illustrated in FIG. 4. Thus, the leg member is processed to have a leading-end leg portion which is subsequently subjected to thread-rolling. The resultant leading-end leg portion of the leg member has a larger diameter than that of the intermediate portion thereof. As illustrated in FIG. 4, the forming apparatus is provided with a die 50, and a knock-out member 60. The die 50 has a through bore 51. A bolt precursor "W" is fitted into the through bore 51 from one of the opposite ends of the through bore 51. The knock-out member 60 is fitted into the through bore 51 from another one of the opposite ends of the through bore 51, and is disposed relatively movably therein. The bolt precursor "W", fitted into the through bore 51, is moved relatively with respect to the knock-out member 60 along with the die 50. Accordingly, the leading end of the bolt precursor "W" is pressed against the leading end of the knock-out member 60. Consequently, the bolt precursor "W" is swollen at the leading end in radial directions. The forming apparatus thus carries out the upsetting operation.

Thereafter, the swollen leading-end leg portion of the bolt precursor "W", formed by the upsetting operation, is subjected to drawing in order to carry out shaping. After the shaping operation, the leading-end leg portion of the precursor "W" is subjected to thread-rolling in order to form screw threads thereon. Finally, the bolt precursor "W" is subjected to hexagonal-head shaping at the head member, round-flange trimming at the head member, a surface treatment, and the like, if necessary. An axially-extendable bolt is thus completed.

When preparing a bolt precursor in the above-described manner, a metallic rod-shaped blank is sheared in the following manner. As illustrated in FIG. 5, a cutter quill 70, and a cutter 80 are first disposed parallelly. The cutter quill 70 has a through bore 71, and the cutter 80 has a through bore 81. The through bores 71 and 81 are communicated with each other linearly. Then, a metallic rod-shaped blank "A" is fitted into the through bores 71 and 81. Finally, the cutter 80 is moved heavily in a shearing direction with respect to the cutter quill 70. However, when the metallic rod-shaped blank "A" is sheared, the cut surface of the resulting bolt precursor "W" is not flat because a sheared surface "d", and a fractured surface "e" arise therein as illustrated in FIG. 6(*a*). The disadvantages result from the existence of clearances "a", "b" and "c" shown in FIG. 5. The clearances "a" and "b" are formed between the inner peripheral surfaces of the through bores 71 and 81, into which the metallic rod-shaped blank "W" is fitted, and the outer peripheral surface of the metallic rod-shaped blank "W". The clearance "c" is formed between the facing surfaces of the cutter quill 70 and cutter 80. In addition, as illustrated in FIG. 6(*b*), a running "f" arises on the outer periphery adjacent to the cut surface of the resultant bolt precursor "W". As a result, irregularities arise in portions adjacent to the cut surface of the resultant bolt precursor "W".

When the bolt precursor "W" having the defects is subjected to the upsetting operation as illustrated in FIG. 4, there arises a problem in that a dent "g" is likely to develop in the upset portion because an uneven thickness is likely to occur, and because the upsetting accuracy is prone to be unstable. As illustrated in FIG. 7, when the dent "g" is developed, an oblique drawing takes place eventually in the subsequent drawing operation for shaping the upset portion of the bolt precursor "W". As a result, an axial run-out occurs in the drawn portion, and the perpendicularity deteriorates therein. All in all, there emerges a problem in that these drawbacks finally result in the deterioration in the qualities of a completed bolt.

The applicant of the present invention has proposed a novel process for forming a bolt in Japanese Patent Application No. 7-209,461. The novel bolt forming process is intended for securing a flatness in the leading-end surface of a leg member of a bolt. In the novel bolt forming process, in order to carry out the objective, a bolt precursor is flowed radially outwardly at a portion adjacent to the leading-end surface, and simultaneously the flowed portion is removed by cutting. When the novel bolt forming process is applied to the above-described upsetting operation, it is possible to inhibit the aforementioned uneven thickness from arising, because the flowed portion is removed by cutting. However, it is necessary to carry out post-processing the burrs and flashes, which have been produced by cutting. Consequently, there might arise a drawback in that the man-hour requirement, and the cost of equipment increase.

SUMMARY OF THE INVENTION

The present invention has been developed in order to solve the aforementioned conventional problems. It is therefore an object of the present invention to provide a process for forming an axially-extendable bolt by upsetting, which can produce the following advantages. The bolt forming process can inhibit the uneven thickness from arising, uneven thickness which results from the irregularities at the sheared leading end of a bolt precursor. Further, the bolt forming process can avoid the deterioration in the qualities of a completed axially-extendable bolt. Furthermore, the bolt forming process scarcely pushes up the manhour requirement and the cost of equipment.

An embodiment of the present invention can carry out the object, and comprises the steps of:

preparing a die, a rod-shaped bolt precursor, and a knock-out member, the die including a through bore, the through bore having opposite ends, an intermediate portion and an inner peripheral surface, the opposite ends having a predetermined diameter, the intermediate portion having an internal upsetting cavity, the internal upsetting cavity having a diameter larger than that of the opposite ends, the bolt precursor having a predetermined diameter, a leading-end surface, a leading end, an intermediate portion and a trailing end and being fitted into the through bore from one of the opposite ends of the through bore, the knock-out member fitted into the through bore of the die from the other one of the opposite ends of the through bore, the knock-out member including a leading end and an inclined surface, the leading end having a flat leading-end surface, the inclined surface having a diameter increasing away from the leading-end surface and forming a buffer space between itself and the inner peripheral surface of the through bore;

primarily pressing the leading end of the bolt precursor, being fitted into the through bore, onto the leading end of the knock-out member, thereby flowing an excess material of the bolt precursor adjacent to the leading-end surface thereof out into the buffer space, and producing an axially-and-outwardly projecting flash on an outer periphery of the leading end of the bolt precursor; and secondarily pressing the bolt precursor onto the knock-out member, thereby swelling the intermediate portion of the bolt precursor in the internal upsetting cavity of the die, and providing an upset portion with the bolt precursor.

The thus arranged embodiment of the present invention operates as hereinafter described. In the preparing step, the bolt precursor is fitted into the through bore of the die from one of the opposite ends of the through bore, and the knock-out member is fitted into the through bore of the die from the other one of the opposite ends of the through bore. Thus, the bolt precursor and the knock-out member are disposed so that they can be brought into contact with each other.

In the primarily-pressing step, the leading end of the bolt precursor is pressed onto the leading end of the knock-out member to start a bolt-forming process. Accordingly, the diameter of the bolt precursor is swollen finely at the leading end, and the leading end thereof is brought into contact with the inner peripheral surface of the through bore of the die. Subsequently, a further pressing load is applied to the bolt precursor. Consequently, an excess material is flowed out into the buffer space, excess material which is present adjacent to the leading-end surface of the bolt precursor. Note that the term, "excess material", herein means the irregularities which have been generated by shearing. As a result, an axially-and-outwardly projecting flash is formed on the leading-end outer periphery of the bolt precursor. All in all, the irregularities, which have been generated by shearing, are equalized or corrected.

Thereafter, in the secondarily-pressing step, a furthermore pressing load is applied to the bolt precursor in order to carry out an upsetting operation. The pressing load is applied to the flat leading-end surface of the knock-out member and to the leading-end surface of the bolt precursor which is pressed against the flat leading-end surface of the knock-out member. Accordingly, the bolt precursor is swollen in radial directions, and fills up the internal upsetting cavity. Thus, the bolt precursor can be upset uniformly without producing an uneven thickness at the upset portion, because the irregularities, which have been generated by shearing, are equalized or corrected by providing the axially-and-outwardly projecting flash on the leading-end outer periphery of the bolt precursor. In addition, the bolt precursor can be securely provided with a flat surface, which conforms to the flat-leading end surface of the knock-out member, at the central area of the leading-end surface.

Thus, in accordance with the embodiment of the present invention, it is possible to inhibit the uneven thickness, which has resulted from the irregularities in the sheared end of the bolt precursor, from arising. As a result, when drawing the bolt precursor in the subsequent step, it is possible to avoid obliquely drawing the bolt precursor. All in all, it is possible to obviate the deterioration in the qualities of a completed axially-extendable bolt, deterioration which has resulted from the degraded axial run-out and perpendicularity.

In addition, in accordance the embodiment of the present invention, it is unnecessary to dare to remove the axially-and-outwardly projecting flash, which is present on the leading-end outer periphery of the bolt precursor. Accordingly, it is possible to obviate the machining on the leading-end surface of the bolt precursor, the undesirable and tiresome post-processing after removing the flash, etc. Thus, it is possible to reduce the cost of a completed axially-extendable bolt.

Optionally, the embodiment of the present invention can preferably be modified as follows:

For instance, the bolt precursor can be prepared as a workpiece by shearing a metallic rod-shaped blank;

The die can comprise an upsetting die, and a holding die. The upsetting die can include a first through bore. The holding die can be held on the upsetting die and include a second through bore which communicates coaxially with the first through bore. Further, the internal upsetting cavity can comprise a major-diameter internal concavity, an intermediate internal concavity, and an internal concavity. The major-diameter internal concavity can be disposed at a middle of the internal upsetting cavity and have opposite ends. The intermediate internal concavity can be formed as an inverted truncated cone and disposed at one of the opposite ends of the major-diameter internal concavity continuously therefrom. The internal concavity can be formed as a truncated cone and disposed at the other one of the opposite ends of the major-diameter internal concavity continuously therefrom. Furthermore, the upsetting die can be provided with the major-diameter internal concavity and intermediate internal concavity. The holding die can be provided with the internal concavity;

In the primarily pressing step, the axially-and-outwardly projecting flash can be produced by utilizing a frictional resistance which is generated when the leading end of the bolt precursor is pressed onto the flat leading-end surface of the knock-out member to finely swell the diameter of the bolt precursor and to bring the leading end of the bolt precursor into contact with the inner peripheral surface of the through bore of the die;

In the primarily pressing step, an irregularity, arising at the leading end of the bolt precursor, can be equalized or corrected by producing the axially-and-outwardly projecting flash on an outer periphery of the leading end of the bolt precursor;

The primarily pressing step can be carried out by applying a pressing force in respect of the flat leading-end surface of the knock-out member, and in respect of the leading-end surface of the bolt precursor pressed onto the flat leading-end surface of the knock-out member;

The primarily and secondarily pressing steps can be carried out by utilizing a frictional resistance which is exerted between the inner peripheral surface of the through bore of the die and the leading end of the bolt precursor pressed onto the inner peripheral surface of the through bore; and A supplementally-pressing step can be further included. The supplementally-pressing step is carried out between the primarily and secondarily pressing steps. In the supplementally-pressing step, the bolt precursor is pressed onto the knock-out member so that the leading end is swollen to bring the leading end into contact with the inner peripheral surface of the die.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 6 schematically illustrates a bolt precursor prepared by shearing, in which:

FIG. 6(*a*) is a front view of the bolt precursor viewed on an opposite-end side of the bolt precursor; and FIG. 6(*b*) is a side view of the bolt precursor.

DETAILED DESCRIPTION OF THE PREFERRED EMBODIMENTS

Having generally described the present invention, a further understanding can be obtained by reference to the specific preferred embodiment which is provided herein for the purpose of illustration only and not intended to limit the scope of the appended claims.

The specific preferred embodiment will be hereinafter described with reference to the accompanying drawings.

Preferred Embodiment

Figure 1:
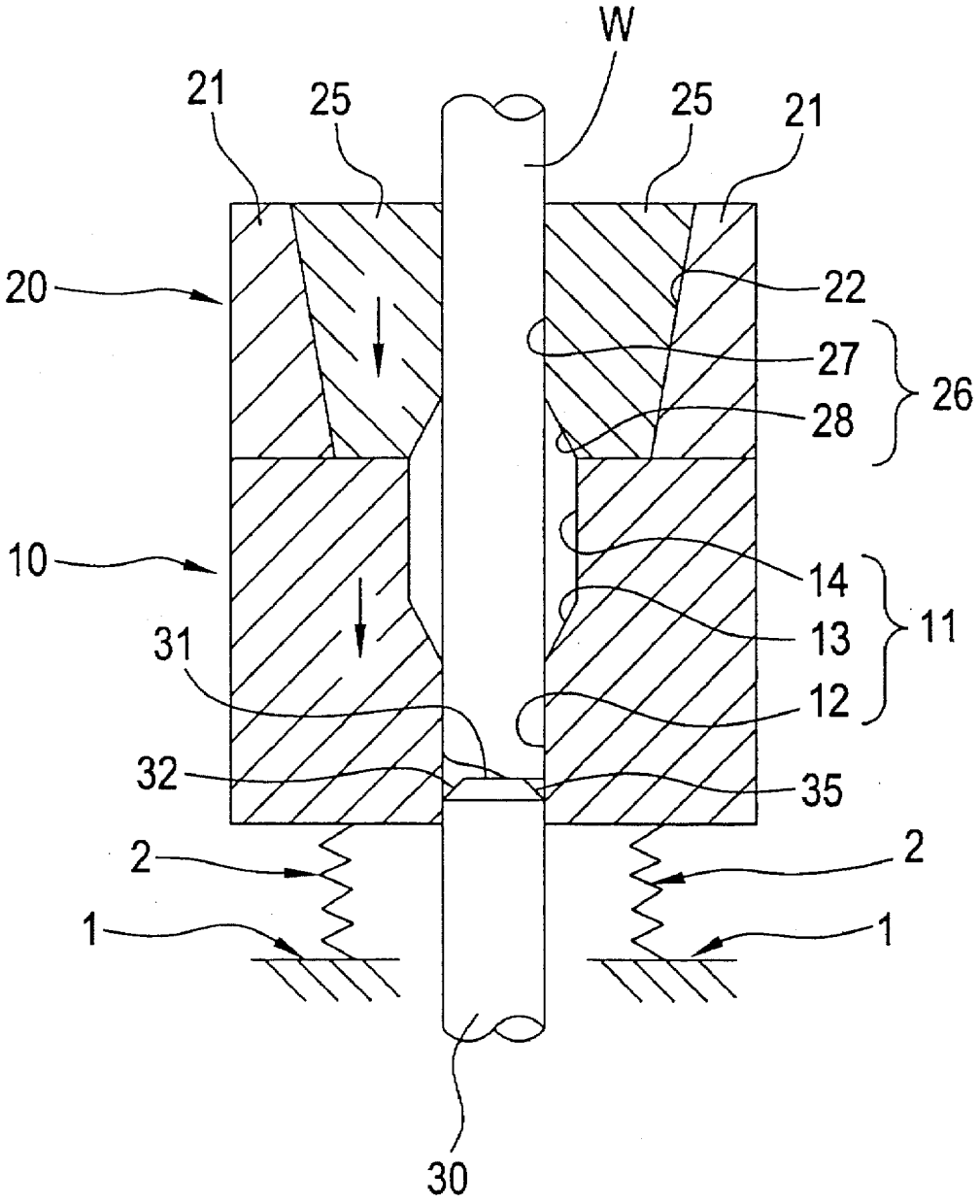
FIG. 1 schematically illustrates a forming apparatus which is utilized in a bolt-forming process of a Preferred Embodiment according to the present invention.

FIG. 1 schematically illustrates a forming apparatus which is utilized in a bolt-forming process of a Preferred Embodiment according to the present invention.

The bolt-forming process of the Preferred Embodiment is applied to upsetting a bolt precursor "W" in a manufacturing process of an axially-extendable bolt. As illustrated in FIG. 1, the forming apparatus employed in the bolt-forming process comprises an upsetting die 10, a holding die 20, and a knock-out member 30. The upsetting die 10 includes a through bore 11. The holding die 20 is fastened onto the upsetting die 10, and includes a through bore 26. The through bore 26 communicates with the through bore 11 coaxially. The knock-out member 30 is fitted into the through bore 11 of the upsetting die 10 on the bottom-end side of the through bore 11.

The upsetting die 10 is formed as a cylindrical shape substantially, and includes the through bore 11. The through bore 11 penetrates through the upsetting die 10 vertically. The through bore 11 has a minor-diameter internal concavity 12, an intermediate internal concavity 13, and a major-diameter internal concavity 14. The minor-diameter internal concavity 12 is disposed on the bottom-end side of the through bore 11, and is formed as a cylindrical shape. The intermediate internal concavity 13 is connected with the top end of the minor-diameter internal concavity 12, and formed as an inverted truncated cone shape. Accordingly, the intermediate internal concavity 13 has a diameter which enlarges as it develops upward. The major-diameter internal concavity 14 is connected with the top end of the intermediate internal concavity 13. Note that the major-diameter internal concavity 14 is formed so as to have an inside diameter which is substantially equal to the maximum outside diameter of the bolt precursor "W" to be subjected to upsetting. The upsetting die 10 is disposed on a base 1 by way of coil springs 2, 2 so as to be movable in the vertical directions.

The holding die 20 includes an outer ring member 21, and a holding ring member 25. The outer ring member 21 is fastened to the top-end surface of the upsetting die 10 at one of the opposite-end surfaces, and includes a tapered inner peripheral surface 22. The tapered inner peripheral surface 22 has an inside diameter which enlarges as it develops upward. The holding ring member 25 is disposed inside the outer ring member 21, and is engaged therewith slidably in the vertical directions. Moreover, the holding ring member 25 is provided with a through bore 26. The through bore 26 penetrates through the holding ring member 25 vertically. The through bore 26 of the holding ring member 25 includes a holding bore 27, and a lower internal concavity 28. The holding bore 27 holds the bolt precursor "W" which is fitted into the through bore 26. The lower internal concavity 28 is formed as a truncated cone shape. Accordingly, the lower internal concavity 28 has a diameter which enlarges as it develops downward away from the bottom end of the holding bore 27, and conforms to the major-diameter internal concavity 14 of the upsetting die 10 at the bottom end.

The holding ring member 25 is divided into 4 sections in the circumferential direction. Consequently, when the holding ring member 25 is engaged with the outer ring member 21 along the inner peripheral surface 22 of the outer ring member 21 downward from top to bottom, it reduces in radial directions. Thus, the holding ring member 25 holds the bolt precursor "W", which is fitted into the through bore 26, with the holding bore 27.

The knock-out member 30 is formed as a cylindrical shape which has an outside diameter substantially equal to the inside diameter of the minor-diameter internal concavity 12 of the upsetting die 10. The knock-out member 30 is fastened to the base 1 while it is fitted into the minor-diameter internal concavity 12 of the upsetting die 10 at the top leading end. The leading end of the knock-out member 30 is provided with a circular flat leading-end surface 31, and an inclined surface 32. The inclined surface 32 is inclined so as to have an outside diameter which enlarges as it develops away from the leading-end surface 31 to the trailing end of the knock-out member 30. The thus arranged knock-out member 30 forms a buffer space 35 between itself and the upsetting die 10. Specifically, the buffer space 35 is formed between the inclined surface 32 and the inner peripheral surface of the through bore 11 which faces the inclined surface 32. The buffer space 35 takes in an excess material which flows out of the leading end of the bolt precursor "W". Note that the inclined angle and dimension of the inclined surface 32 can be determined appropriately depending on the size, etc., of the buffer space 35 to be formed. In addition, the inclined surface 32 can be formed linearly or curvedly with respect to the inclined direction.

A bolt-forming process will be hereinafter described, bolt-forming process which utilizes the thus arranged forming apparatus in order to carry out an upsetting operation onto the bolt precursor "W".

The bolt precursor "W" employed herein is prepared as a workpiece by shearing a metallic rod-shaped blank. The resulting bolt precursor "W" is subjected to axial drawing, thereby forming a leg member having a predetermined diameter and simultaneously forming a head member of an axially-extendable completed bolt.

The bolt precursor "W" is disposed in the forming apparatus in the following state. As illustrated in FIG. 1, the leg member of the bolt precursor "W" is fitted into the through bore 11 of the upsetting die 10, and into the through bore 26 of the holding die 20 from the top side of the holding die 20. The leading end of the leg member is brought into contact with the leading-end surface 31 of the knock-out member 30. In this state, the bolt precursor "W" is held between the four sections of the holding member 25, and is firmly fixed in the holding bore 27. Under the circumstance, an actuator (not shown) presses the upsetting die 10 and holding die 20 downward. Accordingly, the upsetting die 10 and holding die 20 move relatively with respect to the knock-out member 30, thereby starting a bolt-forming operation.

Figure 2:
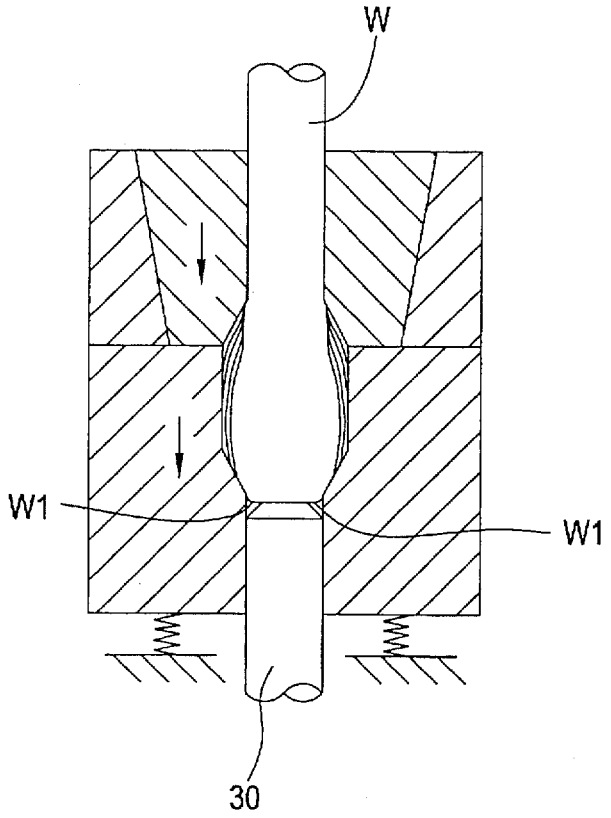
FIG. 2 schematically illustrates a state in the bolt-forming process of the Preferred Embodiment, state which is immediately before completing the bolt-forming process.
Figure 3:
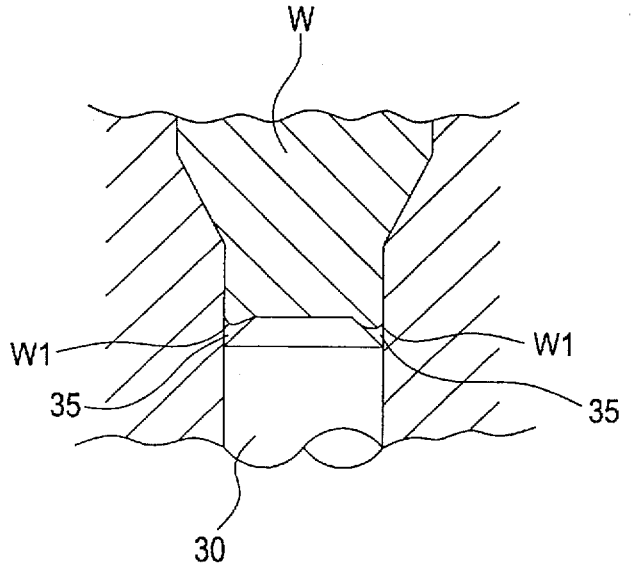
FIG. 3 schematically illustrates major portions of FIG. 2 in enlarged cross-section.
Figure 4:
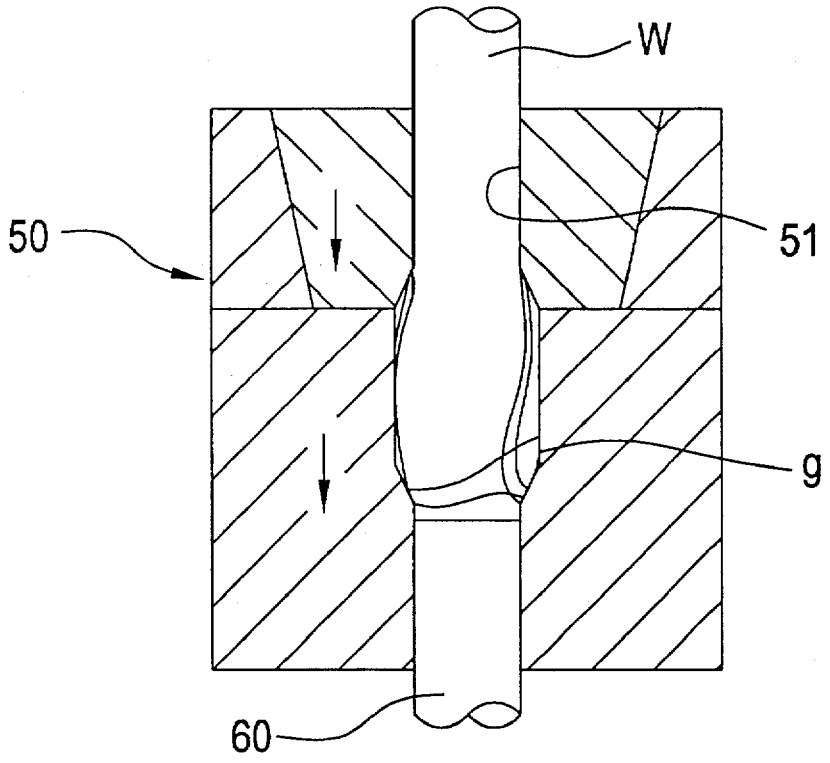
FIG. 4 (PRIOR ART)
FIG. 4 schematically illustrates a conventional bolt-forming process.
Figure 5:
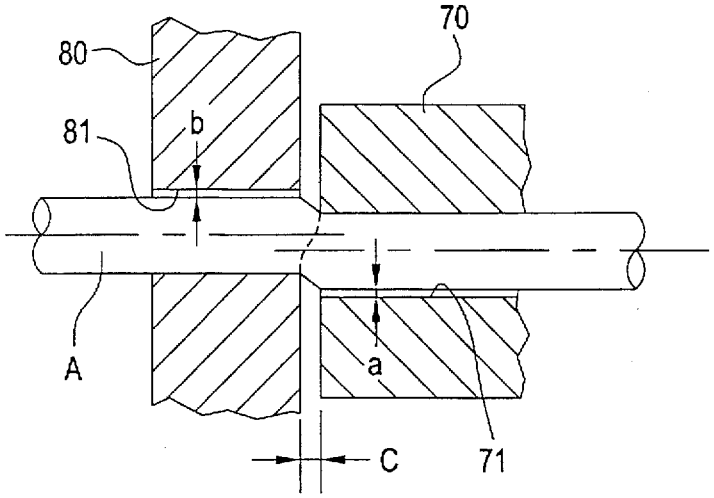
FIG. 5 (PRIOR ART)
FIG. 5 schematically illustrates how a metallic rod-shaped blank is sheared in the conventional bolt-forming process.
Figure 6A:
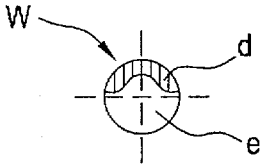
FIG. 6(a) (PRIOR ART)
Figure 6B:
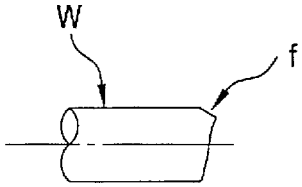
FIG. 6(b) (PRIOR ART)
Figure 7:
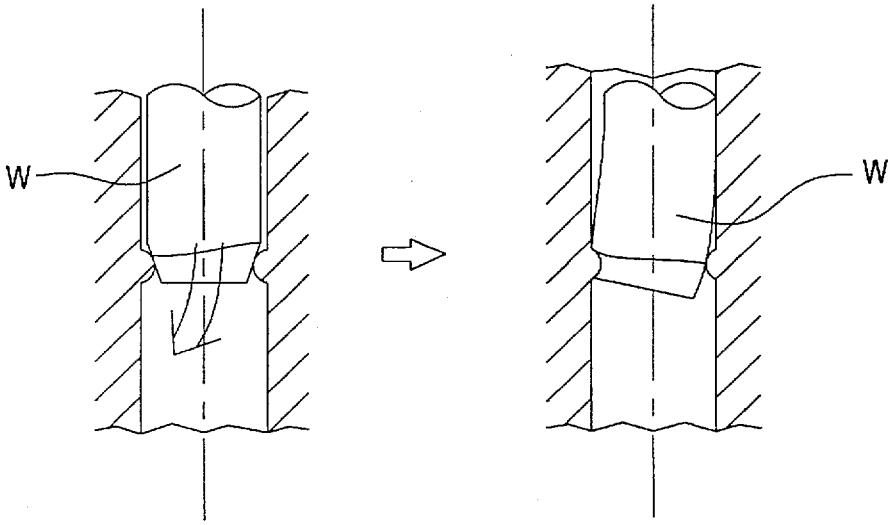
FIG. 7 (PRIOR ART)
FIG. 7 schematically illustrates how the bolt precursor is deformed in a drawing step of the conventional bolt-forming process.

Thus, the leading end of the bolt precursor "W", held by the holding die 20, is pressed onto the flat leading-end surface 31 of the knock-out member 30 so that the diameter of the leading end is swollen finely. As a result, the leading end of the bolt precursor "W" is pressed onto the inner peripheral surface of the minor-diameter internal concavity 12 of the through bore 11. Subsequently, a further pressing load is applied to the bolt precursor "W". Consequently, as illustrated in FIGS. 2 and 3, an excess material is flowed out into the buffer space 35, excess material which is present adjacent to the leading-end surface of the bolt precursor "W". Note that the term, "excess material", herein means the irregularities which have been generated by shearing. As a result, an axially-and-outwardly projecting flash "$W_1$" is formed on the leading-end outer periphery of the bolt precursor "W". All in all, the irregularities, which have been generated by shearing, are equalized or corrected.

Thereafter, when the bolt precursor "W" receives a furthermore pressing load, the pressing load is applied to the flat leading-end surface 31 of the knock-out member 30 and to the leading-end surface of the bolt precursor "W" which is pressed against the flat leading-end surface 31 of the knock-out member 30. Accordingly, the bolt precursor "W" is swollen in radial directions, and fills up the upsetting cavity which is constituted by the intermediate internal concavity 13 and the major-diameter internal concavity 14 of the through bore 11, and the lower internal concavity 28 of the through bore 26. In this instance, the bolt precursor "W" can be upset uniformly without producing an uneven thickness at the upset portion, because the irregularities, which have been generated by shearing, are equalized or corrected by providing the axially-and-outwardly projecting flash "$W_1$" on the leading-end outer periphery of the bolt precursor "W". In addition, the bolt precursor "W" can be securely provided with a flat surface, which conforms to the flat-leading end surface 31 of the knock-out member 30, at the central area of the leading-end surface.

Thus, the bolt-forming process of the Preferred Embodiment can inhibit the uneven thickness, which has resulted from the irregularities in the sheared end of the bolt precursor "W", from arising. As a result, when drawing the bolt precursor "W" in the subsequent step, it is possible to avoid obliquely drawing the bolt precursor "W". All in all, it is possible to obviate the deterioration in the qualities of a completed axially-extendable bolt, deterioration which has resulted from the degraded axial run-out and perpendicularity.

Having now fully described the present invention, it will be apparent to one of ordinary skill in the art that many changes and modifications can be made thereto without departing from the spirit or scope of the present invention as set forth herein including the appended claims.

What is claimed is:

1. A process for forming an axially-extendable bolt by upsetting, the process comprising the steps of:

preparing a die, a rod-shaped bolt precursor, and a knock-out member, the die including a through bore, the through bore having opposite ends, an intermediate portion and an inner peripheral surface, the opposite ends having a predetermined diameter, the intermediate portion having an internal upsetting cavity, the internal upsetting cavity having a diameter larger than that of the opposite ends, the bolt precursor having a predetermined diameter, a leading-end surface, a leading end, an intermediate portion and a trailing end and being fitted into the through bore from one of the opposite ends of the through bore, the knock-out member fitted into the through bore of the die from the other one of the opposite ends of the through bore, the knock-out member including a flat leading end and an inclined surface, the flat leading end having a flat leading end surface, the inclined surface having a diameter increasing away from the flat leading end surface and forming a buffer space between itself and the inner peripheral surface of the through bore;

primarily pressing the leading end of the bolt precursor, being fitted into the through bore, onto the flat leading end of the knock-out member, thereby flowing an excess material of the bolt precursor adjacent to the leading end surface thereof out into the buffer space, and producing an axially-and-outwardly projecting flash on an outer periphery of the leading end of the bolt precursor;

secondarily pressing the bolt precursor onto the knock-out member, thereby swelling the intermediate portion of the bolt precursor in the internal upsetting cavity of the die, and providing an upset portion with the bolt precursor; and removing the bolt precursor with the upset portion from the die.

2. The process according to claim 1, wherein the bolt precursor is prepared as a workpiece by shearing a metallic rod-shaped blank.

3. The process according to claim 1, wherein the die comprises an upsetting die, and a holding die, the upsetting die including a first through bore, the holding die being held on the upsetting die and including a second through bore, the second through bore communicating coaxially with the first through bore.

4. The process according to claim 3, wherein the internal upsetting cavity comprises a major-diameter internal concavity, an intermediate internal concavity, and an internal concavity, the major-diameter internal concavity disposed at a middle of the internal upsetting cavity and having opposite ends, the intermediate internal concavity formed as an inverted truncated cone and disposed at one of the opposite ends of the major-diameter internal concavity continuously therefrom, the internal concavity formed as a truncated cone and disposed at the other one of the opposite ends of the major-diameter internal concavity continuously therefrom.

5. The process according to claim 4, wherein the upsetting die is provided with the major-diameter internal concavity and intermediate internal concavity, the holding die is provided with the internal concavity.

6. The process according to claim 1, wherein the axially-and-outwardly projecting flash is produced by utilizing a frictional resistance in said primarily pressing step, frictional resistance which is generated when the leading end of the bolt precursor is pressed onto the flat leading-end surface of the knock-out member to finely swell the diameter of the bolt precursor and to bring the leading end of the bolt precursor into contact with the inner peripheral surface of the through bore of the die.

7. The process according to claim 1, wherein an irregularity, arising at the leading end of the bolt precursor, is equalized in said primarily pressing step by producing the axially-and-outwardly projecting flash on an outer periphery of the leading end of the bolt precursor.

8. The process according to claim 1, wherein said primarily pressing step is carried out by applying a pressing force in respect of the flat leading-end surface of the knock-out member, and in respect of the leading-end surface of the bolt precursor pressed onto the flat leading-end surface of the knock-out member.

9. The process according to claim 1, wherein said primarily and secondarily pressing steps are carried.out by utilizing a frictional resistance which is exerted between the inner peripheral surface of the through bore of the die and the leading end of the bolt precursor pressed onto the inner peripheral surface of the through bore.

10. The process according to claim 1 further including a step of supplementally pressing the bolt precursor onto the knock-out member, thereby swelling the leading end of the bolt precursor to bring the leading end into contact with the inner peripheral surface of the die, the step being carried out between said primarily and secondarily pressing steps.

* * * * *